US007304641B2

(12) United States Patent
Rao et al.

(10) Patent No.: US 7,304,641 B2
(45) Date of Patent: Dec. 4, 2007

(54) TIMING GENERATOR OF FLAT PANEL DISPLAY AND POLARITY ARRANGEMENT CONTROL SIGNAL GENERATION METHOD THEREFOR

(75) Inventors: Yong-Nien Rao, Hsinchu (TW); Shih-Tzung Chou, Jhudong Township, Hsinchu County (TW)

(73) Assignee: Sunplus Technology Co., Ltd., Hsinchu (TW)

( * ) Notice: Subject to any disclaimer, the term of this patent is extended or adjusted under 35 U.S.C. 154(b) by 456 days.

(21) Appl. No.: 10/799,675

(22) Filed: Mar. 15, 2004

(65) Prior Publication Data

US 2005/0012733 A1 Jan. 20, 2005

(30) Foreign Application Priority Data

Jul. 15, 2003 (TW) ..... 92119242 A

(51) Int. Cl.
*G09G 3/36* (2006.01)
*G09G 5/00* (2006.01)

(52) U.S. Cl. ..... 345/209; 345/87; 345/96; 345/99

(58) Field of Classification Search ..... 345/60, 345/79, 96, 99, 209
See application file for complete search history.

(56) References Cited

U.S. PATENT DOCUMENTS

| | | | | |
|---|---|---|---|---|
| 6,628,256 | B2 * | 9/2003 | Nishimura | 345/96 |
| 6,680,722 | B1 * | 1/2004 | Hiraki et al. | 345/96 |
| 6,734,840 | B2 * | 5/2004 | Fukutoku et al. | 345/96 |
| 7,027,025 | B2 * | 4/2006 | Takeda | 345/96 |
| 7,030,843 | B2 * | 4/2006 | Youn | 345/86 |
| 2003/0197672 | A1 * | 10/2003 | Yun et al. | 345/99 |

* cited by examiner

*Primary Examiner*—Henry N Tran
(74) *Attorney, Agent, or Firm*—Bacon & Thomas, PLLC

(57) ABSTRACT

Disclosed is a timing generator of panel display and polarity arrangement control signal generation method therefor. The timing generator comprises a storage unit for storing a plurality of sets of polarity data and corresponding PAC signals, an operation unit for receiving display data, the sets of polarity data, and a corresponding PAC signal so that the operation unit can perform an inner product operation with respect to the polarity data and the display data for obtaining a sum of coupling voltages, and a comparison unit for comparing the sum of coupling voltages with a predetermined value, and outputting the PAC signal corresponding to the polarity data to a data driver if the sum of coupling voltages is smaller than the predetermined value.

10 Claims, 6 Drawing Sheets

TIMING GENERATOR OF FLAT PANEL DISPLAY AND POLARITY ARRANGEMENT CONTROL SIGNAL GENERATION METHOD THEREFOR

BACKGROUND OF THE INVENTION

1. Field of the Invention

The present invention relates to flat panel displays and, more particularly, to a timing generator of flat panel display and polarity arrangement control signal generation method therefor.

2. Description of Related Art

Flat panel display is the dominant type of display in the market. Currently, there are three widely used flat panel displays, namely liquid crystal displays (LCDs), thin film transistor LCDs (TFT-LCDs), and organic electroluminescence display (OELDs). The principles of LCDs or TFT-LCDs are that the orientation of liquid crystal molecules is controlled by bias and in turn the light transmission thereof can be controlled for generating gray scales with a color effect.

However, the liquid crystal molecules may be permanently deformed, resulting in a poor display quality if the liquid crystal molecules are continuously biased by a voltage having the same polarity. Currently, there are a couple of voltage polarity inverting control methods as detailed below. In FIG. 1, a display panel 100 is divided into a plurality of blocks in which a pixel 111 of a first block 110 (i.e., area A) has a polarity opposite to that of a corresponding pixel 121 of an adjacent second block (i.e., area B) or opposite to that of a corresponding pixel 131 of an adjacent third block (i.e., area C). But, the polarities of the pixel 111 of the first block 110 and the corresponding pixel of a fourth block (i.e., area D) are the same.

This is a block-based configuration (e.g., blocks 110, 120, 130, and 140). In a case of column signals of the display panel 100 driven by time division multiplexing, an input pattern can cause a sum of all effective voltages of one polarity applied to the liquid crystal to be much larger than a sum of all effective voltages of the opposite polarity applied to the liquid crystal, which may cause cross-talk. As a result, the display quality will be lowered because picture of one block of the display panel 100 may adversely affect brightness of the pictures of adjacent blocks thereof.

In FIG. 2, a configuration of irregularly changing the polarity arrangement of a panel 200 in the vertical direction (i.e., data line direction) is shown in which any two adjacent blocks have opposite polarities. It is seen that positive and negative polarities along any row line are alternate. However, the above problem still exists. In detail, in a case of column signals of the panel 200 driven by time division multiplexing, an input pattern can cause a sum of all effective voltages of one polarity applied to the liquid crystal to be much larger than a sum of all effective voltages of the opposite polarity applied to the liquid crystal. It may cause cross-talk. As a result, the display quality will be lowered. Thus, the need for improvement still exists in order to mitigate and/or obviate the aforementioned problems.

SUMMARY OF THE INVENTION

An object of the present invention is to provide a timing generator of flat panel display and polarity arrangement control signal generation method therefor so as to decrease cross-talk and improve display quality.

In one aspect of the present invention there is provided a timing generator of a panel display for generating a PAC (Polarity Arrangement Control) signal and sending the same to a data driver so that the data driver is operative to control a polarity of display data based on the PAC signal and send the display data to a display panel, the timing generator comprising a storage unit for storing a plurality of sets of polarity data and a plurality of PAC signals wherein each set of polarity data includes a plurality of data polarities and each set of polarity data corresponds to one of the PAC signals; an operation unit for receiving the display data, the plurality of sets of polarity data, and a corresponding one of the PAC signals so that the operation unit is operative to perform an inner product operation with respect to the polarity data of each set of polarity data and the display data for obtaining a sum of a plurality of coupling voltages corresponding to the polarity data of each set of polarity data; and a comparison unit for comparing the sum of coupling voltages with a predetermined value, and outputting the PAC signal if the sum of coupling voltages is smaller than the predetermined value.

In another aspect of the present invention there is provided a timing generator of a panel display for generating a PAC signal and sending the same to a data driver so that the data driver is operative to control a polarity of display data based on the PAC signal and send the display data to a display panel, the timing generator comprising a storage unit for storing a plurality of sets of polarity data and a plurality of PAC signals wherein each set of polarity data includes a plurality of data polarities and each set of polarity data corresponds to one of the PAC signals; an operation unit for receiving the display data, the plurality of sets of polarity data, and a corresponding one of the PAC signals so that the operation unit is operative to perform an inner product operation with respect to each set of polarity data and the display data for obtaining a sum of a plurality of coupling voltages corresponding to the polarity data; and a comparison unit for comparing the sums of coupling voltages each other for selecting a smallest sum of coupling voltages, and outputting a corresponding one of the PAC signals to the data driver.

In still another aspect of the present invention there is provided a method of generating PAC signal, comprising the steps of receiving display data, at least one set of predetermined polarity data, and at least one PAC signal corresponding to the at least one set of PAC data; performing an inner product operation with respect to the at least one set of PAC data and the display data for obtaining a sum of at least one coupling voltage; comparing the sum of at least one coupling voltage with a predetermined value; and outputting the PAC signal of polarity data corresponding to the sum of at least one coupling voltage if the sum of at least one coupling voltage is smaller than the predetermined value.

In a further aspect of the present invention there is provided a method of generating PAC signal, comprising the steps of receiving display data, at least one set of predetermined polarity data, and at least one PAC signal corresponding to the at least one set of PAC data; performing an inner product operation with respect to each set of polarity data and the display data for obtaining a sum of a plurality of coupling voltages corresponding to the at least one set of polarity data; comparing the sums of coupling voltages each other for selecting a smallest sum of coupling voltages; and outputting a corresponding PAC signal having the smallest sum of coupling voltages.

Other objects, advantages, and novel features of the invention will become more apparent from the detailed description when taken in conjunction with the accompanying drawings.

DETAILED DESCRIPTION OF THE PREFERRED EMBODIMENT

Figure 1:
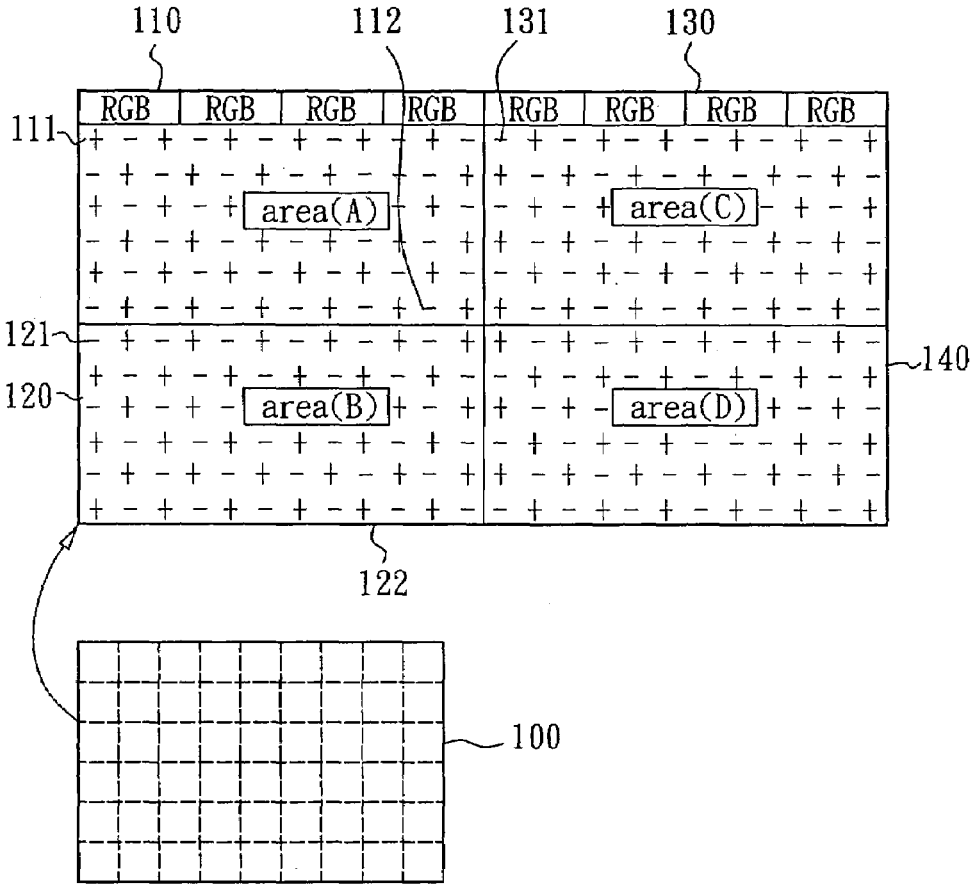
FIG. 1 PRIOR ART
FIG. 1 schematically depicts a conventional voltage polarity inverting control method by dividing a display panel into a plurality of blocks.
Figure 2:
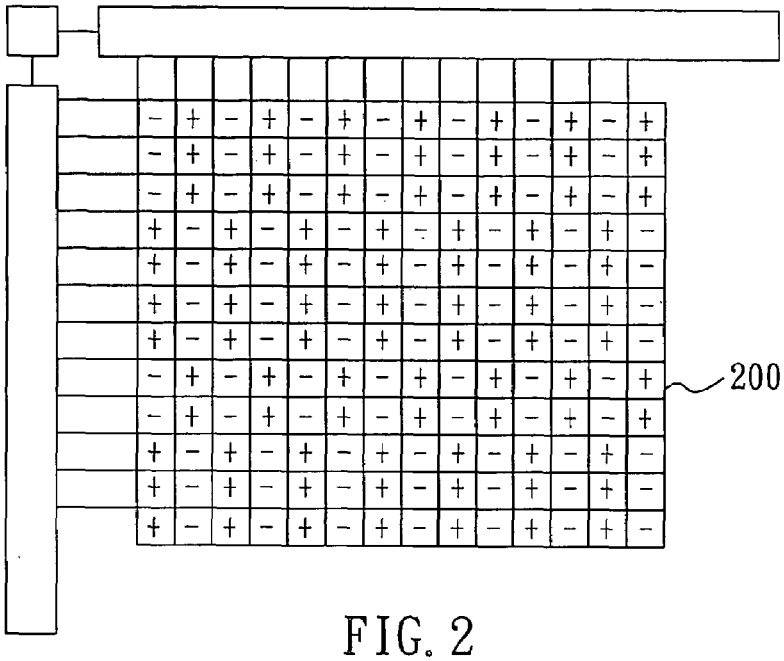
FIG. 2 PRIOR ART
FIG. 2 schematically depicts another conventional configuration having alternate positive and negative polarities along any row line of a display panel.
Figure 3:
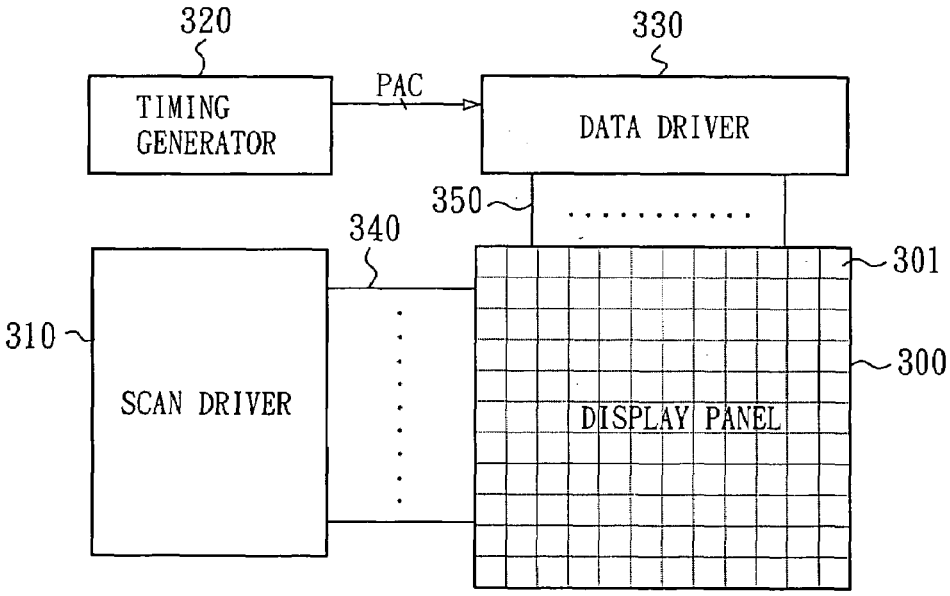
FIG. 3 schematically depicts a structure applicable to the invention.

With reference to FIG. 3, there is shown a structure constructed in accordance with the invention comprising a display panel 300, a scan driver 310, a timing generator 320, and a data driver 330. Each component will be described in detail below. The display panel 300 comprises a plurality of pixels 301. A plurality of scan lines 340 are interconnected the scan driver 310 and the pixels 301 of the display panel 300. Likewise, a plurality of data lines 350 are interconnected the data driver 330 and the pixels 301 of the display panel 300. In the embodiment, preferably, the display panel 300 is an LCD panel. The timing generator 320 is adapted to generate an optimum PAC (polarity arrangement control) signal and send the same to the data driver 330. Each PAC signal corresponds to one of plural sets of polarity data. As such, the data driver 330 is able to select one of plural sets of polarity data based on the PAC signal. Thus the polarities of the pixels 301 of the display panel 300 can be controlled. As a result, it is possible of decreasing cross-talk and improving display quality. As to how the timing generator 320 generates the optimum PAC signal will be described in detail below.

Figure 4:
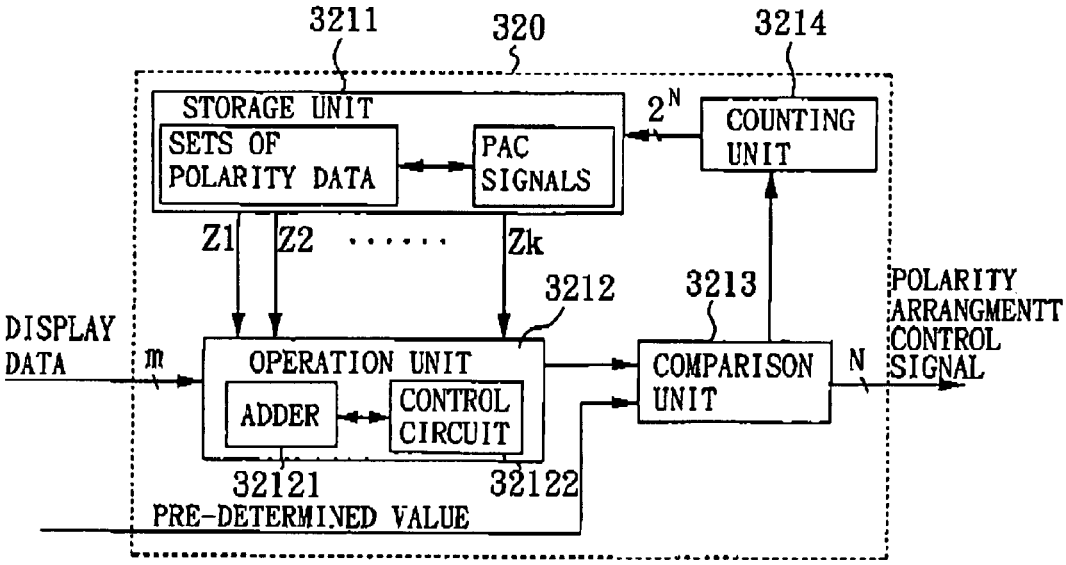
FIG. 4 is a block diagram according to a first preferred embodiment of the invention.

With reference to FIG. 4, the timing generator 320 according to a first preferred embodiment of the invention comprises a storage unit 3211, an operation unit 3212, a comparison unit 3213, and a counting unit 3214. Preferably, the operation unit 3212 is comprised of an adder 32121 and a control circuit 32122 in the embodiment. Preferably, the storage unit 3211 is implemented as a random access memory (RAM) for storing the plural sets of polarity data and the plural PAC signals. Further, each set of polarity data comprises a plural data polarities. Furthermore, each set of polarity data corresponds to one PAC signal. In this example, there are $2^n$ PAC signals corresponding to $2^n$ sets of polarity data, and each set of polarity data has k data polarities, where N is employed to denote the PAC signal. Preferably, there are 16 sets of polarity data (N=4) and there are 300 data polarities (k=300) in the embodiment.

Figure 5:
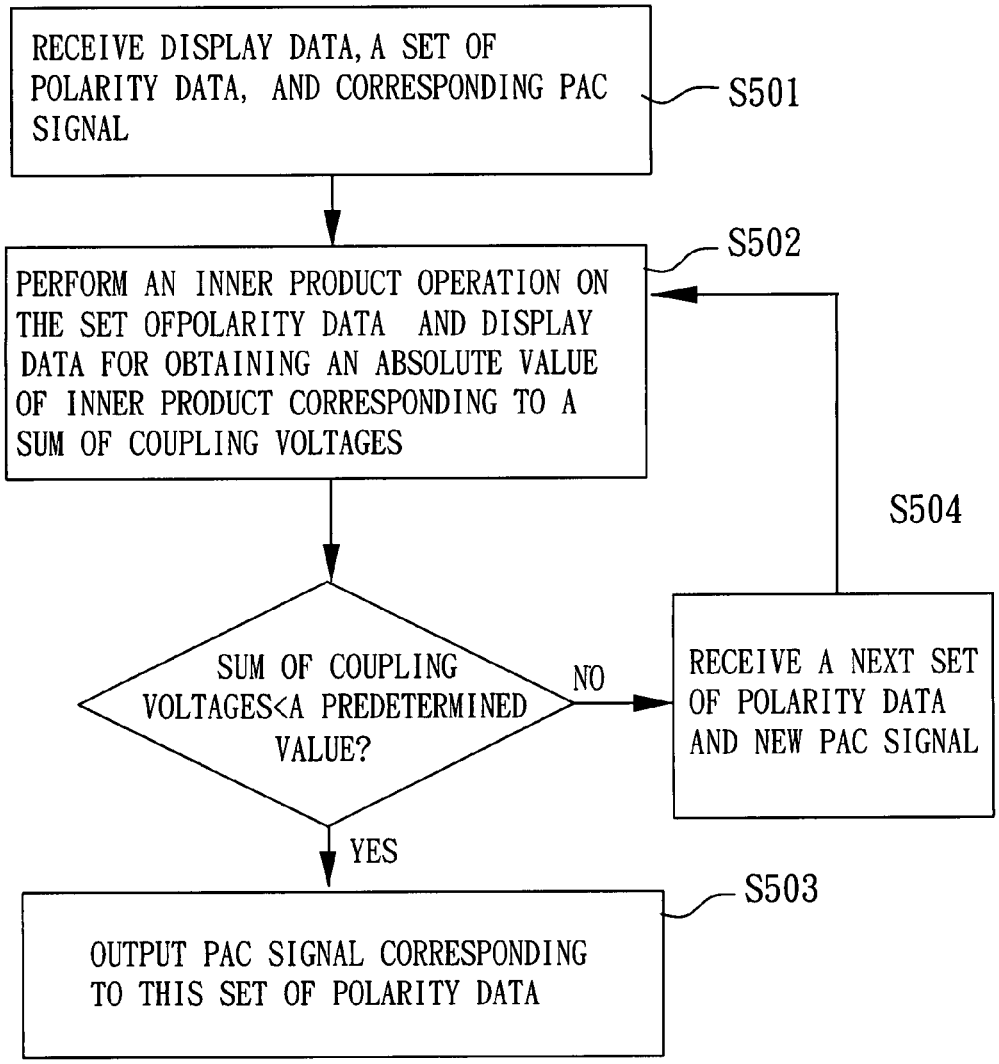
FIG. 5 is a flow chart of the first preferred embodiment of the invention.
Figure 6:
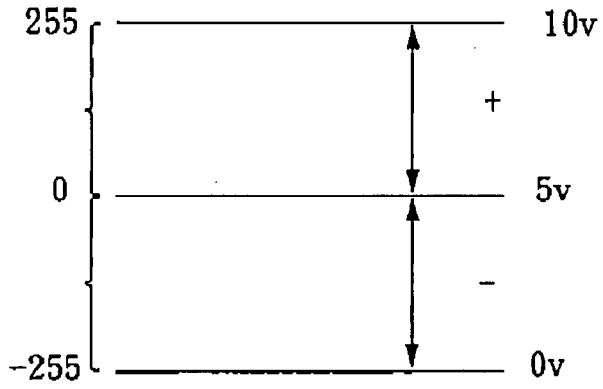
FIG. 6 illustrates operating voltage versus grey level and polarity for the first preferred embodiment of the invention.

A flow chart of the first preferred embodiment of the invention will be illustrated in FIG. 5 in conjunction with FIG. 6. An operating voltage and grey level of the display panel 300 of the embodiment is shown in FIG. 6 in which black is shown at both sides and white is shown in the middle. That is, in a case of an operating voltage 10V applied for controlling the rotation of liquid crystal, the display panel 300 will be black if the operating voltage is 10V or 0V. On the contrary, the display panel 300 will be white if the operating voltage is 5V. Positive polarity is in the region between 5V and 10V and negative polarity is in the region between 0V and 5V respectively. Preferably, there are 256 gray scales between black and white. In some other embodiment of the display panel 300, it is possible of arranging white at both sides and black in the middle depending on designs desired by display panel manufacturers.

The operation unit 3212 is adapted to receive display data representing a voltage vector of no polarity in which the larger of the value of display data the closer to by or 0V the voltage will be. The operation unit 3212 is also adapted to receive one of the plural sets of polarity data in the storage unit 3211 and a corresponding PAC signal (e.g., a first set of polarity data). The elements of the set of polarity data are data polarities in which the corresponding element of the set of polarity data is +1 when the data polarity is positive and on the contrary, the corresponding element of the set of polarity data is −1 when the data polarity is negative (step S501).

Next, the operation unit 3212 uses the adder 32121 to perform an inner product operation with respect to the set of polarity data and the display data for obtaining an absolute value of the inner product as a result. That is, the result corresponds to a sum of coupling voltages of the PAC signal of the set of polarity data. For example, the result is +4 (step S502). The result then is sent to the comparison unit 3213 for comparing with a predetermined value (e.g., +5). It means that the coupling value of the corresponding PAC signal of the set of polarity data (i.e., the absolute value of the sum of coupling voltages) is smaller if the result is smaller than the predetermined value per the comparison in the comparison unit 3213. As an end, it is possible of decreasing cross-talk and improving display quality. Finally, the comparison unit 3213 outputs the PAC signal to the data driver 330 so that the data driver 330 is able to control the polarity arrangement of liquid crystal of the display panel 300 in response to the PAC signal (step S503).

The comparison unit 3213 will output an enable signal to the counting unit 3214 for incrementing the counting unit 3214 by one if the result is larger than the predetermined value. Accordingly, the storage unit 3211 is able to sequentially output a second set of polarity data and the corresponding PAC signal to the operation unit 3212 (step S504). Next, the operation unit 3212 performs an operation with respect to the new set of polarity data and the display data for obtaining a corresponding sum of coupling voltages (step S502). Next, the corresponding sum of coupling voltages is sent to the comparison unit 3213 for comparing with the predetermined value again. The above loop will end once the sum of coupling voltages of the set of polarity data is smaller than the predetermined value. Subsequently, the comparison unit 3213 sends the corresponding PAC signal of the set of polarity data to the data driver 230 (step S503). The corresponding PAC signal of the set of polarity data having the smallest sum of coupling voltages will be outputted if the sum of coupling voltages of each of all sets of polarity data is larger than the predetermined value.

Figure 7:
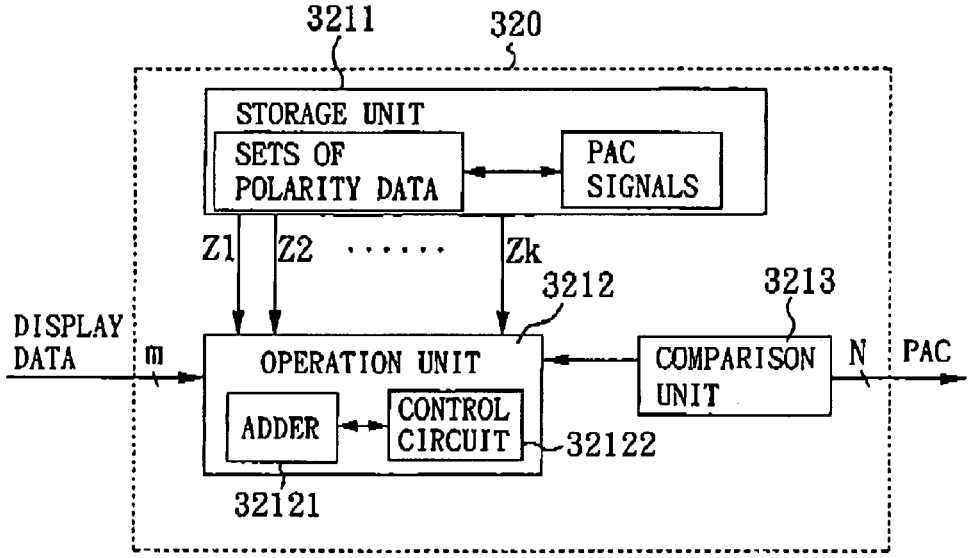
FIG. 7 is a block diagram according to a second preferred embodiment of the invention.
Figure 8:
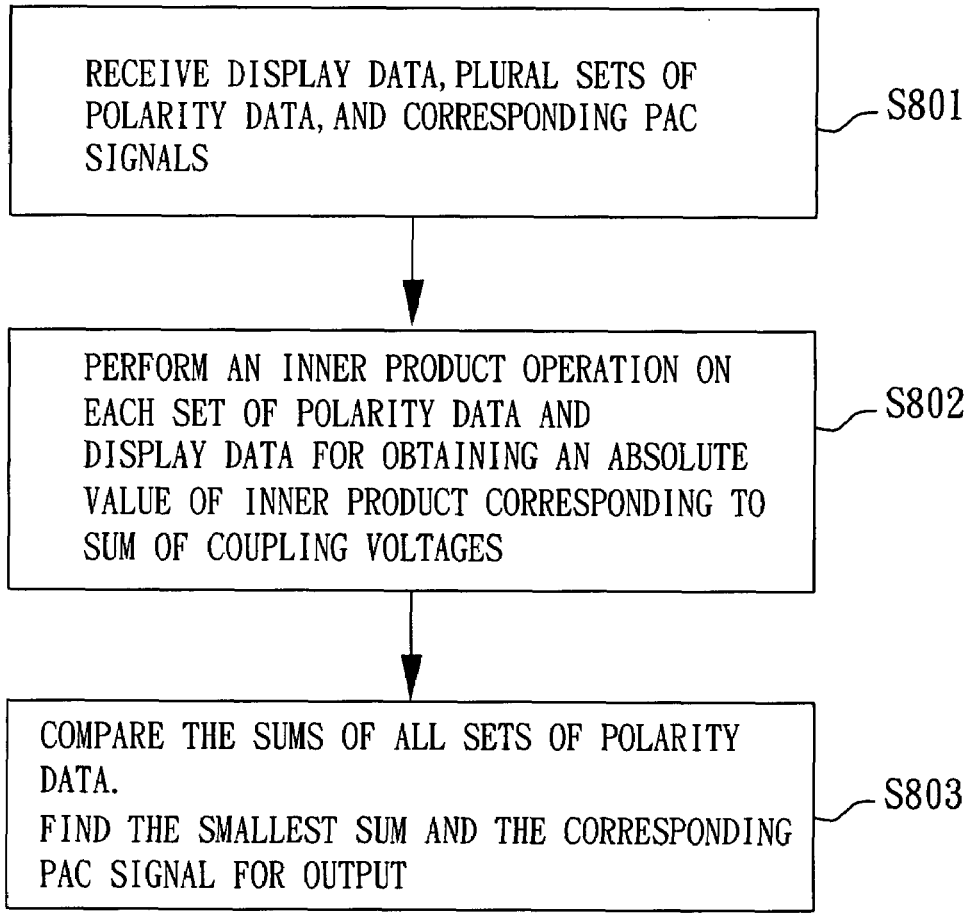
FIG. 8 is a flow chart of the second preferred embodiment of the invention.

A flow chart of a second preferred embodiment of the invention is illustrated in FIG. 8 in conjunction with FIG. 7. The block diagram of PIG. 7 is similar to that of FIG. 4 except that the counting unit 3214 is not required. The process of FIG. 8 begins in step S801 in which the operation unit 3212 receives display data and the storage unit 3211 stores the plural sets of polarity data. The operation unit 3212 then performs an inner product operation with respect to each set of polarity data and the display data for obtaining an absolute value of the inner product as a result. The result corresponds to a sum of coupling voltages of each set of polarity data (step S802). The result then is sent to the comparison unit 3213 for comparing with each other so as to choose the set of polarity data having a smallest sum of coupling voltages and the corresponding optimum PAC signal. As an end, it is possible of decreasing cross-talk. Finally, the comparison unit 3213 outputs the chosen PAC signal to the data driver 330 (step S803)

In view of the foregoing, it is known that, in the invention, a plurality of sets of polarity data and a plurality of corresponding PAC signals are stored in advance, and then an operation is performed with respect to one set of polarity data and the display data for obtaining a corresponding sum of coupling voltages. The sum of coupling voltages of one set of polarity data is compared with a predetermined value. If the sum of coupling voltages of one set of polarity data is smaller than the predetermined value, the corresponding PAC signal of the polarity data is outputted to the data driver. Alternatively, the sums of coupling voltages of the sets of polarity data are compared with each other so as to choose the polarity data having a smallest sum of coupling voltages and the corresponding PAC signal for output. As an end, it is possible of obtaining an optimum polarity arrangement, decreasing cross-talk, and improving display quality.

Although the present invention has been explained in relation to its preferred embodiment, it is to be understood that many other possible modifications and variations can be made without departing from the spirit and scope of the invention as hereinafter claimed.

What is claimed is:

1. A timing generator of a flat panel display for generating a PAC (polarity arrangement control) signal and sending the same to a data driver so that the data driver is operative to control a polarity of display data based on the PAC signal and send the display data to a display panel, the timing generator comprising:

a storage unit for storing plural sets of polarity data and plural PAC signals in advance wherein each said set of polarity data includes plural data polarities and each said set of polarity data corresponds to one of the PAC signals respectively;

an operation unit for receiving the display data, each said set of polarity data, and a corresponding one of the PAC signals so that the operation unit is operative to perform an inner product operation with respect to the polarity data of each said set of polarity data and the display data for obtaining a sum of coupling voltages corresponding to the polarity data of each said set of polarity data; and a comparison unit if or comparing the sum of coupling voltages with a predetermined value, and outputting the corresponding PAC signal if the sum of coupling voltages is smaller than a pre-determined value, thereby generating a PAC signal with the sum of coupling voltages smaller than the pre-determined value.

2. The timing generator as claimed in claim 1, wherein the output PAC signal corresponds to the sum of coupling voltages of the set of polarity data smaller than a predetermined value.

3. The timing generator as claimed in claim 1, wherein the output PAC signal corresponds to the set of polarity data having a smallest sum of coupling voltages if the sum of coupling voltages of each said set of polarity data is larger than the predetermined value.

4. The timing generator as claimed in claim 1, wherein the operation unit comprises an adder for performing an inner product operation with respect to each said set of polarity data.

5. A timing generator of a panel display for generating a PAC (polarity arrangement control) signal and sending the same to a data driver so that the data driver is operative to control a polarity of display data based on the PAC signal and send the display data to a display panel, the timing generator comprising:

a storage unit for storing plural sets of polarity data and plural PAC signals wherein each said set of polarity data includes a plurality of data polarities and each said set of polarity data corresponds to one of the PAC signals;

an operation unit for receiving the display data, the plural sets of polarity data, and the corresponding PAC signals so that the operation unit is operative to perform an inner product operation with respect to each said set of polarity data and the display data for obtaining a sum of coupling voltages corresponding to each said set of polarity data; and a comparison unit for comparing the sums of coupling voltages with each other for selecting a smallest sum of coupling voltages, and outputting a corresponding one of the PAC signals to the data driver, thereby generating a PAC signal with the smallest sum of coupling voltages among the sums of coupling voltages corresponding to all the sets of polarity data.

6. The timing generator as claimed in claim 5, wherein the operation unit comprises an adder for performing an inner product operation with respect to each said set of polarity data.

7. The timing generator as claimed in claim 5, wherein the output PAC signal corresponds to the set of polarity data having the smallest sum of coupling voltages.

8. A method of generating PAC (polarity arrangement control) signal, comprising the steps of:

receiving display data, plural sets of polarity data, and plural PAC signals corresponding to the plural sets of polarity data;

performing an inner product operation with respect to each said set of polarity data and the display data for obtaining a sum of coupling voltages;

comparing the sum of coupling voltages with a predetermined value; and outputting the PAC signal of the set of polarity data corresponding to the sum of coupling voltages if the sum of coupling voltages is smaller than the predetermined value, thereby generating a PAC signal with the sum of coupling voltages smaller than the pre-determined value.

9. The method as claimed in claim 8, further comprising a step of outputting the PAC signal having a smallest sum of coupling voltages if all the sums of coupling voltages are larger than the pre-determined value after the comparison step.

10. A method of generating PAC (polarity, arrangement control) signal, comprising the steps of:

receiving display data, plural sets of predetermined polarity data, and plural PAC signals corresponding to the plural sets of polarity data;

performing an inner product operation with respect to each said set of polarity data and the display data for obtaining a sum of a plurality coupling voltages corresponding to the set of polarity data;

comparing the sums of coupling voltages with each other for selecting a smallest sum of coupling voltages; and outputting a corresponding PAC signal having the smallest sum of coupling voltages, thereby generating a PAC signal with the smallest sum of coupling voltages among the sums of coupling voltages corresponding to all the sets of polarity data.

* * * * *